United States Patent [19]

Watanabe et al.

[11] Patent Number: 4,595,273

[45] Date of Patent: Jun. 17, 1986

[54] COPYING APPARATUS AND METHOD AUTOMATICALLY SEQUENTIALLY COPYING TWO DIFFERENT PAGES OF A DOCUMENT

[75] Inventors: Junji Watanabe, Yokohama; Masahiko Ogura, Fujisawa, both of Japan

[73] Assignee: Tokyo Shibaura Denki Kabushiki Kaisha, Kawasaki, Japan

[21] Appl. No.: 595,359

[22] Filed: Mar. 30, 1984

[30] Foreign Application Priority Data

Mar. 30, 1983 [JP] Japan ..... 58-54305

[51] Int. Cl.[4] ..... G03G 15/00

[52] U.S. Cl. ..... 355/3 R; 355/14 R; 355/8

[58] Field of Search ..... 355/14 E, 55, 46, 14 ER, 355/75, 7, 40, 14 R, 8

[56] References Cited

U.S. PATENT DOCUMENTS 4,173,406 11/1979 Oyama et al. ..... 355/7

4,417,805 11/1983 Kishi ..... 355/7

FOREIGN PATENT DOCUMENTS 2605822 8/1976 Fed. Rep. of Germany .

2810294 9/1978 Fed. Rep. of Germany .

*Primary Examiner*—A. T. Grimley

*Assistant Examiner*—David Warren

*Attorney, Agent, or Firm*—Cushman, Darby & Cushman

[57] ABSTRACT

In a copy machine, two documents are arranged side-by-side on a document table. The documents respectively are copied on copy sheets of the same size as that of the document. In an optical system for scanning the document in the direction of the width of the document, the scanning speed is made to slow down more than that of the normal mode. With the slow down of the scanning speed, images of the document enlarged in the direction of the width of the documents are formed on a photosensitive drum. The enlarged images except the joint portion of the two images are transferred to the copy sheets.

21 Claims, 20 Drawing Figures

COPYING APPARATUS AND METHOD AUTOMATICALLY SEQUENTIALLY COPYING TWO DIFFERENT PAGES OF A DOCUMENT

BACKGROUND OF THE INVENTION

The present invention relates to a copy machine of the type in which a document or documents of two picture frames are arranged on a document table.

A conventional copy machine treats one document or original on the document table as one picture frame and copies the document or original only one frame at a time. For this reason, in copying each page of a notebook on a copy sheet with the same size as that of the page, the notebook must be rearranged for every copying operation of one page. The repetition of this rearrangement is time-consuming and troublesome work. This arises from a structural feature essential to the conventional copy machine that has an optical system containing an exposure lamp, etc. which quickly returns to a scanning starting point after the optical system completes the scanning of one picture frame.

To cope with this problem, a new type of copy machine has recently been developed. In the copy machine, the optical system, after the completion of one picture frame scanning stays at the scanning end point rather than returning to the scanning starting point. Instead, the optical system starts from the scanning end point to start the next scanning operation of a second picture frame. In other words, a document having two picture frames can be arranged on the document table and copied at one time by the so-called two-time scanning method. This type of copy machine halves the time needed to arrange the document and improves copying efficiency. When the two picture frames consist of two separate documents, the documents are set side by side on the document table. In this case, however, even if these documents are well arranged, the space between them will appear as a black line or stripe in the copy image. Further, when a notebook is copied the seam line of the notebook is also copied as a black stripe.

SUMMARY OF THE INVENTION

Accordingly, an object of the present invention is to provide a copy apparatus and method of the type in which a document having two picture frames is arranged on the document table, which successfully removes the joint or seam line problem of the two picture frames.

To achieve the above object, there is provided a copy machine comprising means for designating a size of a copy sheet, optical means for illuminating a document having two picture frames, where the size of each picture frame is equal to the designated size of the copy sheet, for enlarging the image of the document formed by reflecting light from the document, and for forming the enlarged latent image on a photosensitive member, and means for transferring to a copy sheet of the designated size the enlarged latent image except the joint portion of the two frames.

DETAILED DESCRIPTION OF THE PREFERRED EMBODIMENTS

Figure 1:
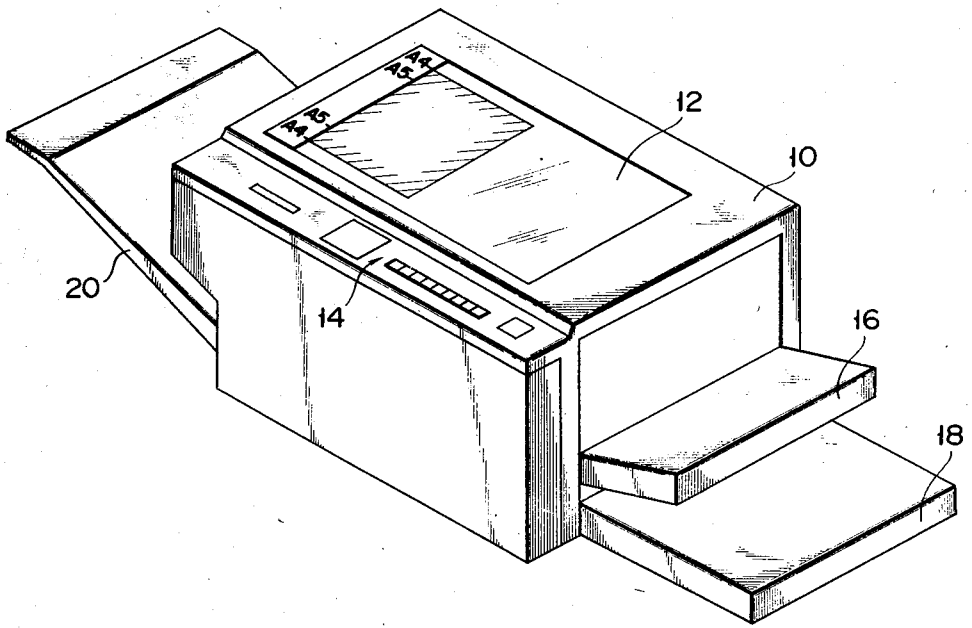
FIG. 1 is a perspective view illustrating the outer appearance of a first embodiment of a copy machine according to the present invention.

A first embodiment of a copy machine according to the present invention will be described referring to FIGS. 1 to 16. FIG. 1 illustrates the outer appearance of the copy machine of the first embodiment. As shown, a main frame 10 has on the upper surface a document table 12 formed by a transparent glass, and an operation panel 14 with various kinds of keys for designating the desired copy size, the number of copies, the desired copy mode, etc. In this copy machine, two paper cassettes 16 and 18, upper and lower, for copying documents of different sizes are loaded into the right end (as viewed in the drawing) of the main frame 10. A document having any size is set vertically on the document table 12. That is, it is aligned so that the left side of the document is lined with the left side of the document table 12. Each cassette also contains a bundle of copy sheets. The copy of the document is discharged from the left side of the main frame 10 and accumulated on a tray 20.

Figure 2:
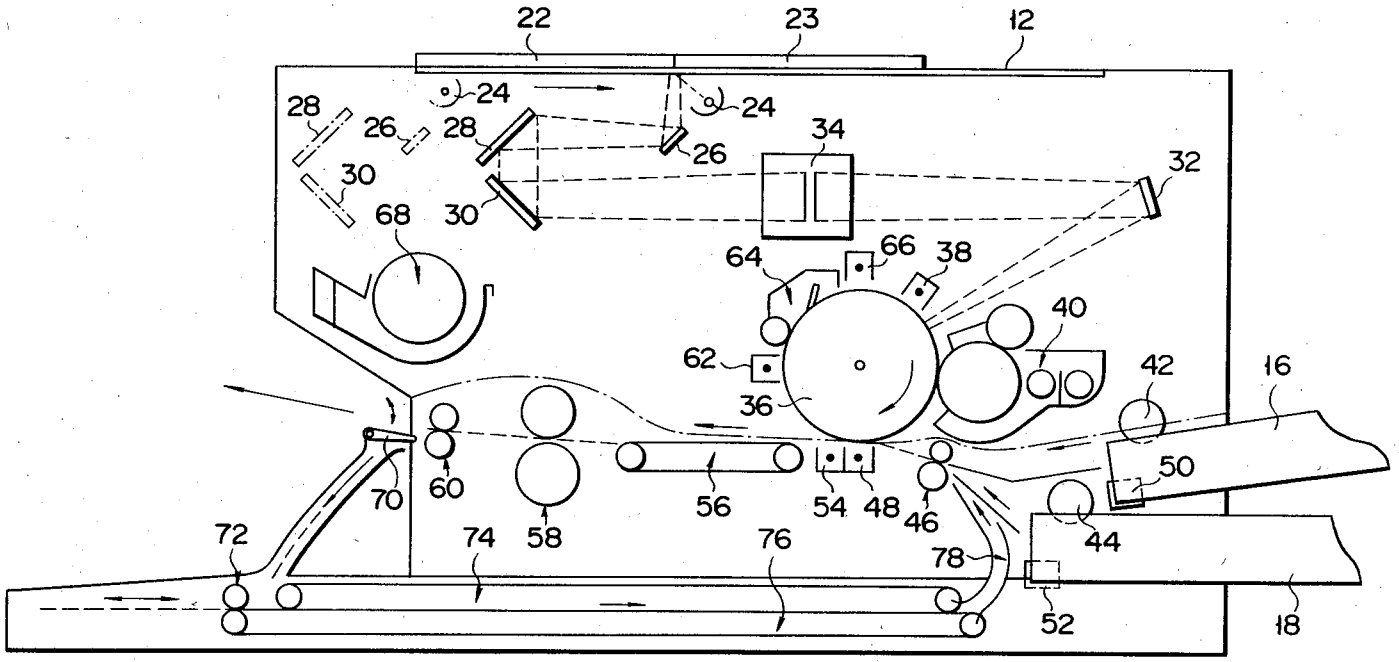
FIG. 2 schematically illustrates a cross section of the first embodiment.
Figure 3:
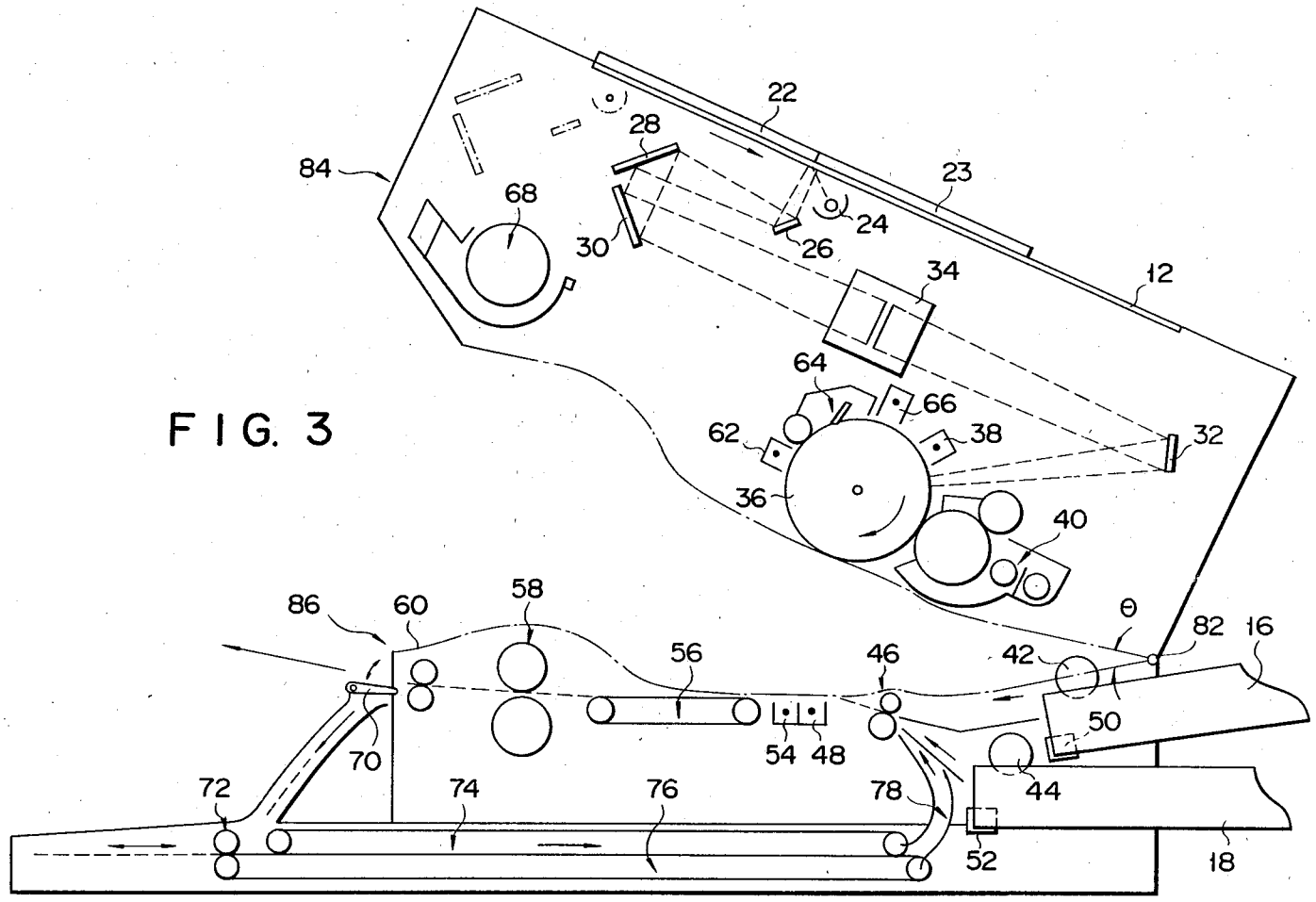
FIG. 3 schematically illustrates a cross section of the first embodiment when the upper unit is raised.

FIG. 2 is the schematic illustration of the structure of the present embodiment. Documents 22 and 23 which are arranged on the document table 12 are illuminated by an optical system containing an exposure lamp 24 and mirrors 26, 28 and 30 when the optical system moves in the direction of the arrow. The home position (stand-by position) of the optical system is at the illumination or exposure end point as indicated by the solid line, not at the left end of the document, i.e., the illumination starting point. The reasons for this will be given later. When the exposure lamp 24 and the mirror 26 move at speed V, the mirrors 28 and 30 move at speed ½ V. The reason why the moving speeds of those components are so set is that the length of the optical path from the document 22 via the mirrors 26, 28 and 30 to a fixed mirror 32 is kept constant so that the size of the document will be the same as that of the copy image, i.e., when the copy magnification is set at "1". A magnification changing lens block 34 is interposed between the mirror 30 and the fixed mirror 32 to reduce the copy from a B4 size to an A4, for example, or to enlarge copy from an A4 size to a B4 size. The reflecting light from the document 22 is reflected by the fixed mirror 32, and led to the photosensitive drum 36. At this time, the photosensitive drum 36 is exposed to a slit light. The photosensitive drum 36 is rotated in the direction of the arrow which is synchronized with the scanning operation of the optical system. The photosensitive drum 36 is charged with a positive charge by a charger 38. Then, the photosensitive drum 36 is illuminated with light reflected from the document 22 to create an electrostatic latent image of the document on the surface thereof. The electrostatic latent image is applied with toner which is negatively charged by a developer 40 to become visualized. Then, either the upper cassette 16 or the lower cassette 18 is selected and the copy sheets contained therein are taken out sheet-by-sheet by means of a roller 42 (or 44). Each sheet is directed to a pair of aligning rollers 46 which rotate together with the photosensitive drum 36 at a predetermined timing, thereby feeding each sheet between the transfer device 48 and the photosensitive drum 36. The cassettes 16 and 18 are removably inserted into the right lower portion of the main frame 1. Cassette size sensors 50 and 52 are provided in the insertion holes for the cassettes 16 and 18. The cassette size sensors 50 and 52 each contain a plurality of microswitches which are turned on and off in response to the size of the inserted cassette.

The copy sheet fed from the aligning roller pair 46 is in contact with the photosensitive drum 36. Under this contact, the transfer device 48 applies positive charges to the copy sheet and the toner image is transferred from the photosensitive drum 36 onto the copy sheet. The copy sheet with the transferred toner image is then separated from the photosensitive drum 36 by a separator 54, and is transferred to a pair of fixing rollers 58 by a transfer belt 56. The fixing roller pair 58 applies heat and pressure to the copy sheet, thereby fixing the toner image. After fixing, copy is discharged to the outside of the main frame by a pair of discharge rollers 60.

The photosensitive drum 36, after it is subjected to the toner transfer process, reaches a charge remover 62. The charge remover 62 removes charges on the photosensitive drum 36. Further, the residual toner on the surface of the drum 36 is removed by a cleaner 64. Further, an afterimage (residual charges) is erased by a discharge lamp 66. At this point, the drum 36 is returned to its initial state.

To prevent an excessive temperature rise in the main frame, a cooling fan 68 is provided near the discharge roller pair 60.

The present embodiment is so designed that after one side of the copy sheet is copied, the copy sheet is reversed and returned to the aligning roller pair 46 to copy the image on the reverse side of the copy sheet. To be more specific, a gate 70 is provided on the outside of the discharge roller pair 60. In a both-side copy mode, the gate 70 is operated to allow the copy sheet emanating from the discharge roller pair 60 to be transferred to the left (as viewed in the drawing) by the inverting roller pair 72. Then, the rotation of the inverting roller pair 72 is inverted and the copy sheet is transferred to the right side, i.e., to the cassette side, through the lower portion of the main frame, while being nipped by transfer belts 74 and 76. The copy sheet released from the transfer belts 74 and 76 is inverted by an inverting path 78, and is transferred again into the aligning roller pair 46.

A copy machine thus arranged is divided into two units, upper and lower units 64 and 86, along the copy sheet transfer path as indicated by a dotted line in FIG. 2. The copy machine is opened by raising the upper unit 84 to form an angle $\theta$ with the lower unit 36. When jam trouble occurs during the transfer of the copy sheet, the upper unit 84 is opened to allow the removal of the jammed sheet. As described above, the home position of the optical system is not in the left end, but in the center portion of the main frame, i.e., the portion closer to a shaft 82 joining the upper and lower units 84 and 86. Therefore, a less amount of moment is required to open the upper unit 84.

Figure 4:
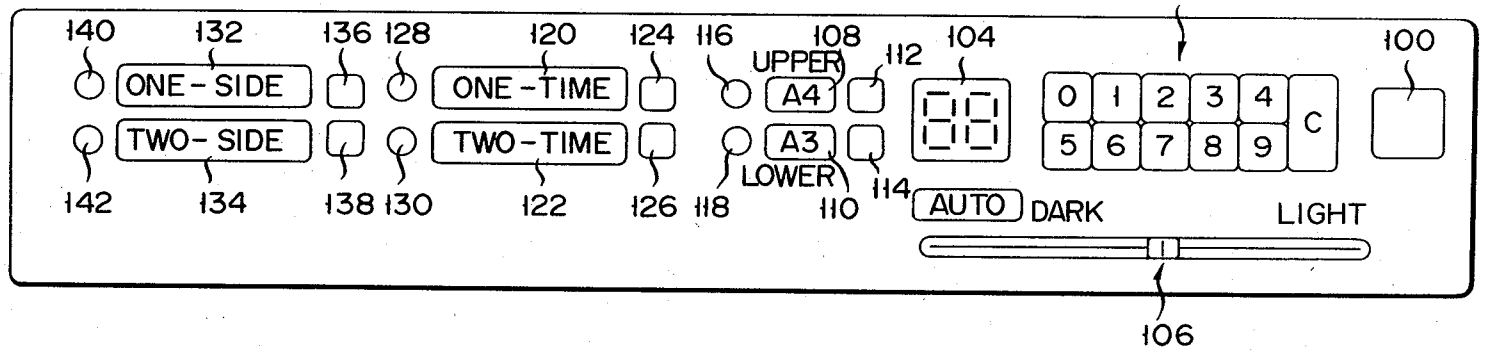
FIG. 4 shows a plan view of an operation panel of the embodiment of FIG. 1.

A plan view of the operation panel 14 provided on the upper surface of the main frame of the copy machine is illustrated in FIG. 4. As shown, a start key 100 for starting the copying operation, a plurality of ten keys 102 for setting a desired number of copies, and a display 104 for displaying the number of copies, and a gray level setter 106 for setting the gray level of the copy image, are arranged from right to left in the drawing. The sizes of the upper and lower cassettes are respectively displayed by displays 108 and 110. A select keys 112 and 114 are disposed on the right side of the displays 108 and 110. LEDs 116 and 118 showing the selection of the cassettes are provided on the left side of the displays 108 and 110. Scanning mode displays 120 and 122 are provided to select either a one-time scanning mode or a two-time scanning mode. Select keys 124 and 126 are provided on the right sides of the displays 120 and 122. LEDs 128 and 130 are provided on the left side to displays the selection made by the select keys. Displays 132 and 134 display a single-side copy and a double-side copy, respectively. Select keys 136 and 138 are provided on the right side of displays 132 and 134. LEDs 140 and 142 are located to the left of those keys to display the selection made by the select keys 136 and 138.

Figure 5:
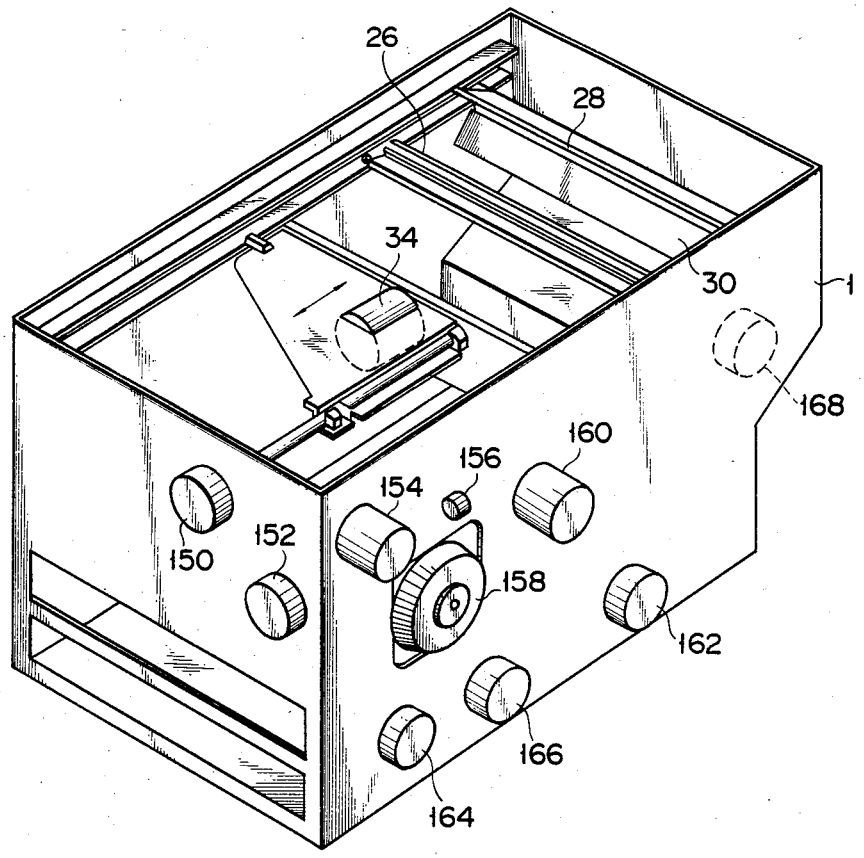
FIG. 5 is a perspective view illustrating how pulse motors as drive sources in the embodiment are allocated.

FIG. 5 shows an allocation of drive sources which are made of pulse motors. The drawing of FIG. 5 is depicted as if viewed from the rear side of the copy machine, although the FIG. 1 drawing shows the front side of the copy machine. A magnification changing motor 150 is provided for changing the location of the magnification changing lens block 34. The motor 152 changes the distance (optical path) between the mirror 26 and the mirror 28 when the copy magnification is changed. A scanning motor 154 moves the exposure lamp 24 and the mirrors 26, 28 and 30 for scanning the document. A shutter motor 156 moves the shutter (not shown) to adjust the charging width of the charge on the photosensitive drum 36 which is formed by the charger 38 when the copy magnification is changed. A developing motor 158 drives the developing roller of the developer 40. A drum motor 160 drives the photosensitive drum 36. A fixing motor 162 drives the transfer belt 56, the fixing roller pair 58, and the discharge roller pair 60. A paper feed motor 164 drives the feed rollers 42 and 44. A paper feed motor 166 drives the aligning roller pair 46. A fan motor 168 drives a cooling fan 68.

Figure 6:
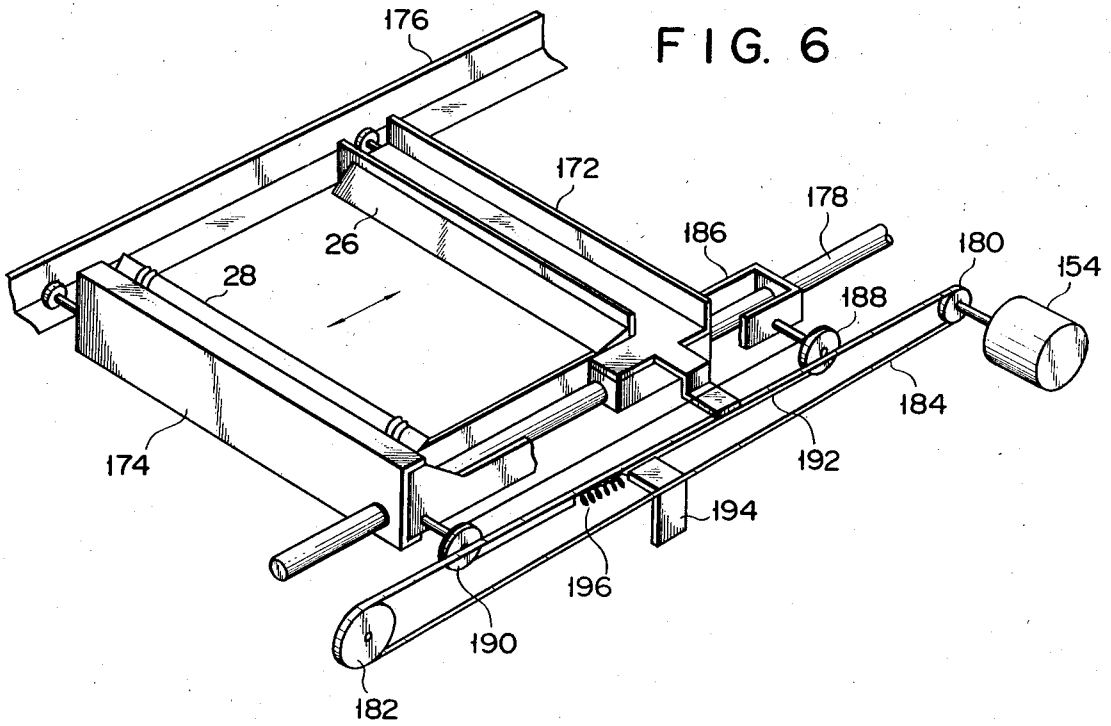
FIG. 6 is a perspective view of a scanning mechanism for moving an optical system in the embodiment.

FIG. 6 shows a scanning mechanism for moving the optical system comprised of the exposure lamp 24 and the mirrors 26, 28 and 30 along the document table. The mirror 26 and exposure lamp 24 are supported by a first carriage 172, and the mirrors 28 and 30 by a second carriage 174. These carriages 172 and 174 can move in the direction of the arrow along with the guide rails 176 and 178. The scanning motor 154 has a 4-phase pulse motor which drives a pulley 180. An endless belt 184 is wound around this pulley 180 and an idle pulley 182. The first carriage 172 supporting the mirror 26 is fixed at one end to the mid-portion of the endless belt 184. A couple of rotatable pulleys 188 and 190 are mounted to the guide 186 of the second carriage 174. The pulleys 188 and 190 are covered with a wire 192. One end of the wire 192 is fixed to a fixing piece 194, while the other end is fixed to the fixing piece 194 via a coiled spring 196. One end of the first carriage 172 is fixed to the mid-portion of the wire 192. With the rotation of the pulse motor 154, the belt 184 rotates causing the first carriage 172 to move. In turn, the second carriage 174 also moves. At this time, the pulleys 188 and 190 serve as a fall block. Therefore, the second carriage 174 moves at half of the speed of the first carriage 172 while traveling in the same direction as the first carriage 172. The moving direction of the first and second carriages 172 and 174 can be changed by reversing the rotating direction of the pulse motor 154.

When the copy size has been selected (specifically, from either the upper cassette 16 or the lower cassette 18), the first carriage 172 is located at a position equal to the width of the copy sheet (its length is in the scanning direction) from the left end of the document table 12 (the opposite end of the cassette). This position is the home position of the first carriage 172. At this time, the second carriage is located on the left side of the first carriage 172.

Figure 7:
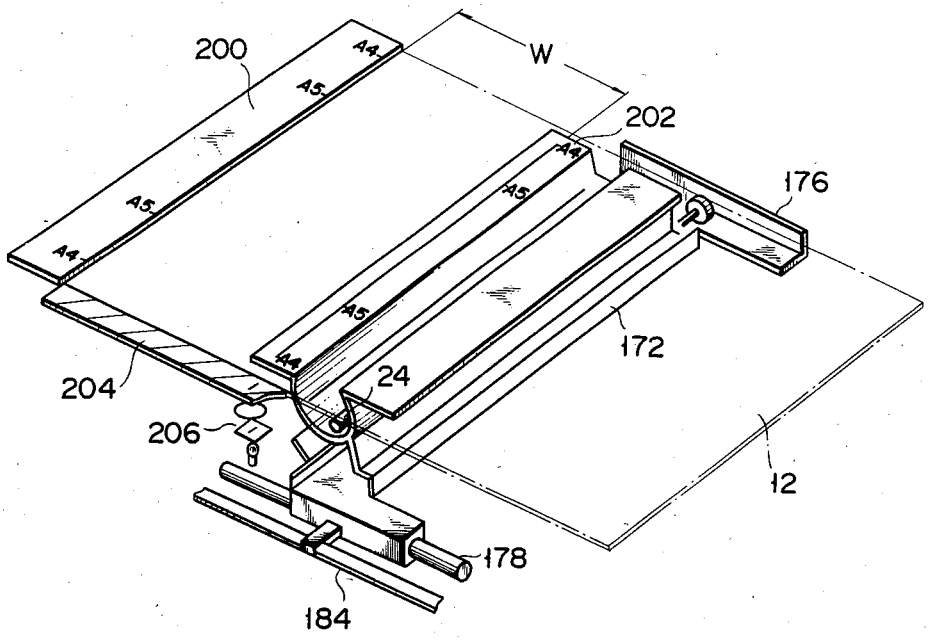
FIG. 7 is a perspective view of a document table capable of displaying a copy allowable range.
Figure 8:
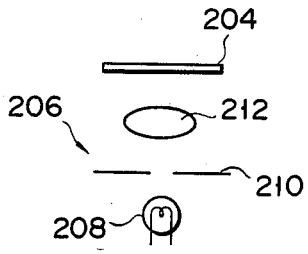
FIG. 8 is a cross-sectional view of an auxiliary display section used for the copy allowable range display.

The position of the first carriage 172 when a copy sheet of the A4 size is selected, is shown in FIG. 7. Each document is vertically set on the document table 12. Provided on the left end of the document table 12 is a scale 200 indicating the length of various copy allowable ranges. The first carriage 172 is also provided with a scale 202 indicating the length of the copy allowable range. As shown, each of the scales 200 and 202 is marked with A4 and A5 indicating the upper and lower limits of the copy allowable ranges. The part 204 of the document table 12 which is outside the copy area of the table, is made of frosted glass. The first carriage 172 has an auxiliary display 206 at a portion corresponding to the frosted glass portion. The auxiliary display 206 lights up from the instant the copy size is designated until the copy scanning is started. In this way, the copy allowable width is displayed on the frosted glass portion 204. The auxiliary display section 206 comprises a light source 208, a slit 210 and a lens 212, as shown in FIG. 8.

Figure 9:
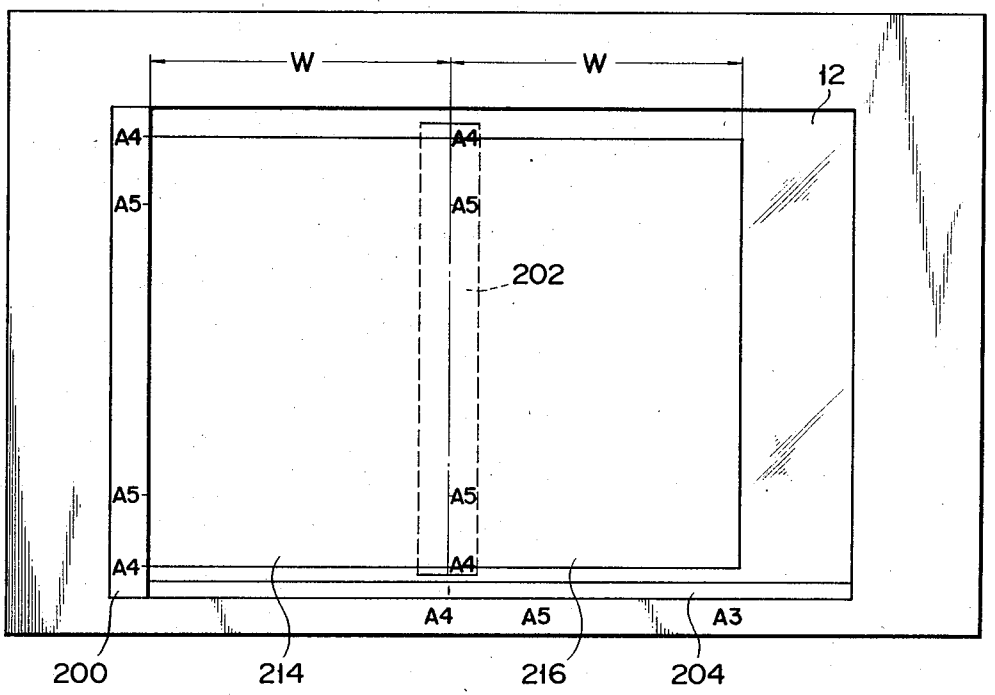
FIG. 9 is a plan view of a document table on which two documents are arranged.

FIG. 9 is a plan view of the section corresponding to the structure shown in FIG. 7. In this illustration, two documents 214 and 216 of A4 size are placed side by side on the document table 12 for the two-time scanning mode to be given later.

Figure 10:
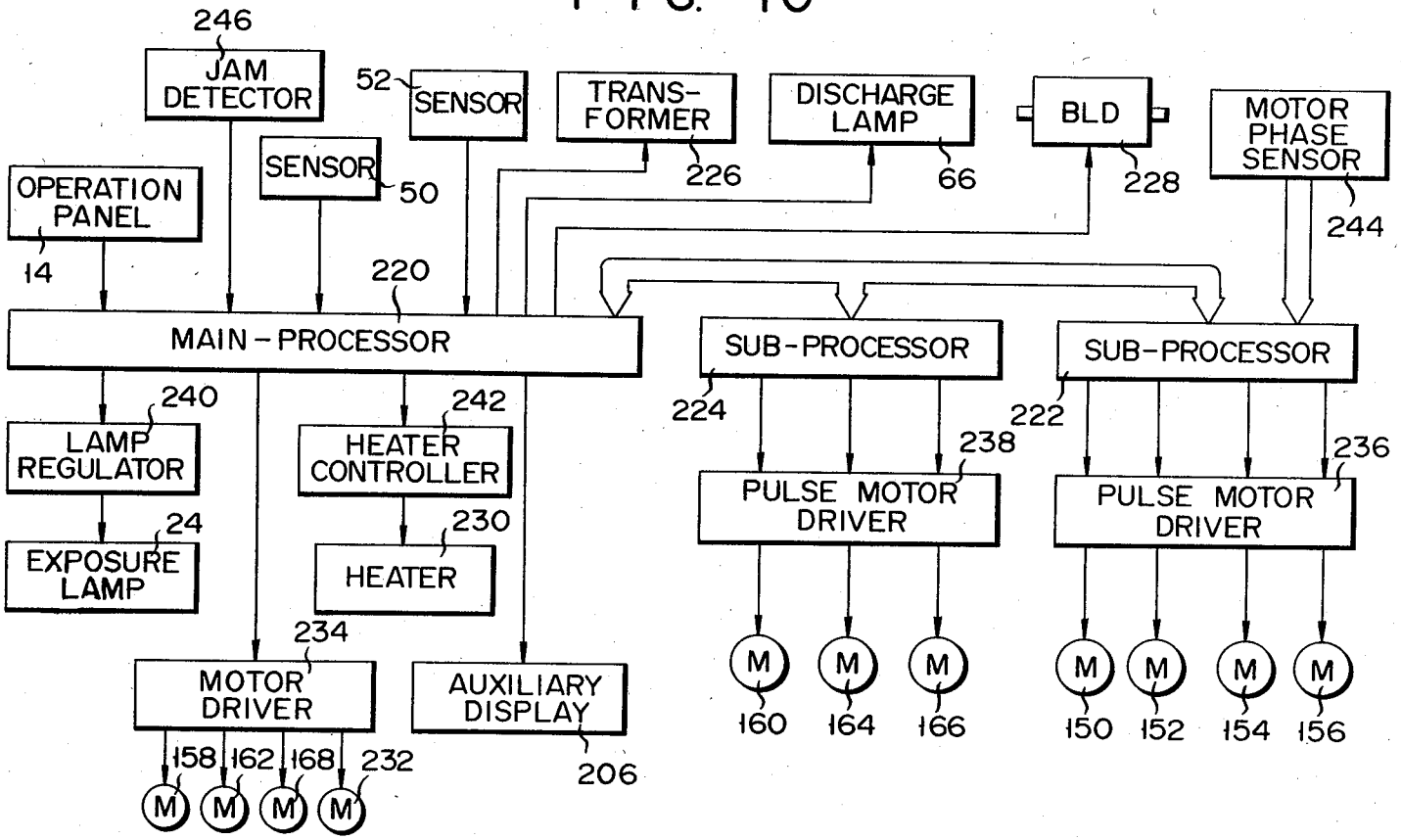
FIG. 10 is a block diagram illustrating the overall control system for the embodiment.

Turning now to FIG. 10, there is illustrated the overall control system of the present embodiment. As shown, the control system comprises a main processor 220, and first and second sub-processors 222 and 224. The main processor 220 detects signals from the operation panel 14 and the cassette size sensors 50 and 52, and controls a high voltage transformer 226, the discharge lamp 66, a blade solenoid (BLD) 228 of the clearner 64, a heater 230 of the fixing roller pair 58, the exposure lamp 24 and the motors 150 to 168. Of those motors 150 to 168, the motors 158, 162 and 168 and a motor 232 for supplying toner to the developer 40 are controlled by the main processor 220 through a motor driver 234. The motors 150, 152, 154 and 156 are controlled by the first sub-processor 222 through a pulse motor driver 236, and the motors 160, 164 and 166 are controlled by the second sub-processor 224 through a pulse motor driver 238. The exposure lamp 24 is controlled by the main processor 220 through a lamp regulator 240. A heater 230 is controlled by the main processor 220 through a heater controller 242. The main processor 220 sends motor drive and stop commands to the first and second sub-processors 222 and 224. These sub-processors 222 and 224 send status signals representing the drive and stop of the motors to the main processor 220. The main processor 220 is also connected to a jam detector 246 on the transfer path. The first sub-processor 222 is supplied with position data from a motor phase sensor 244 for detecting the initial position of each of the motors 150, 152, 154, and 156.

Figure 11:
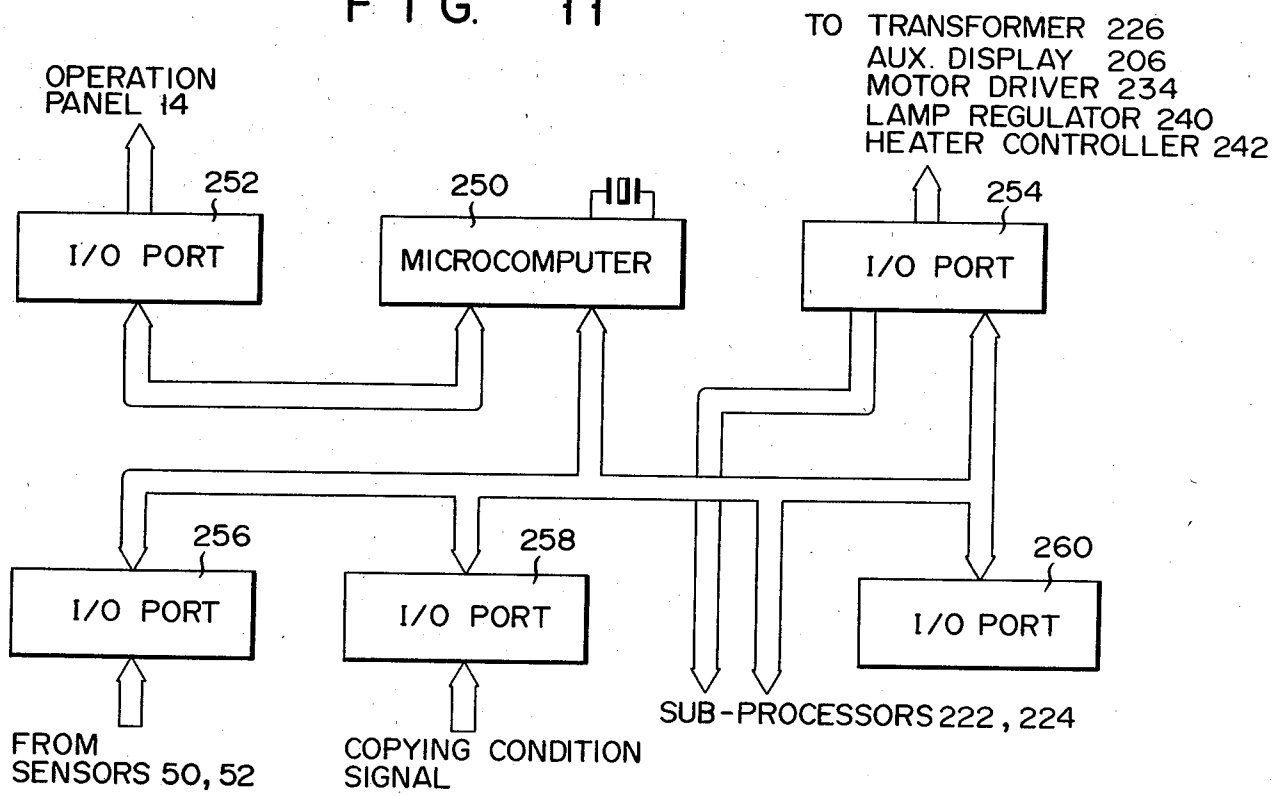
FIGS. 11 to 13 are respectively block diagrams showing a main processor, a first sub-processor, and a second sub-processor which are in the circuit of FIG. 10.

FIG. 11 shows an arrangement of the main processor 220. A microcomputer 250 detects key-in signals from the operation panel 14 through an I/O port 252, and controls various displays. The microcomputer 250 is provided with I/O ports 254, 256, 258 and 260. The I/O port 254 is coupled with the transformer 226, the auxiliary display 206 the motor driver 234, the lamp regulator 240, and the heater controller 242. The I/O port 256 is coupled with the cassette size sensors 50 and 52, and the I/O port 258 receives the copy condition set signal. The I/O port 260 is optionally used.

Figure 12:
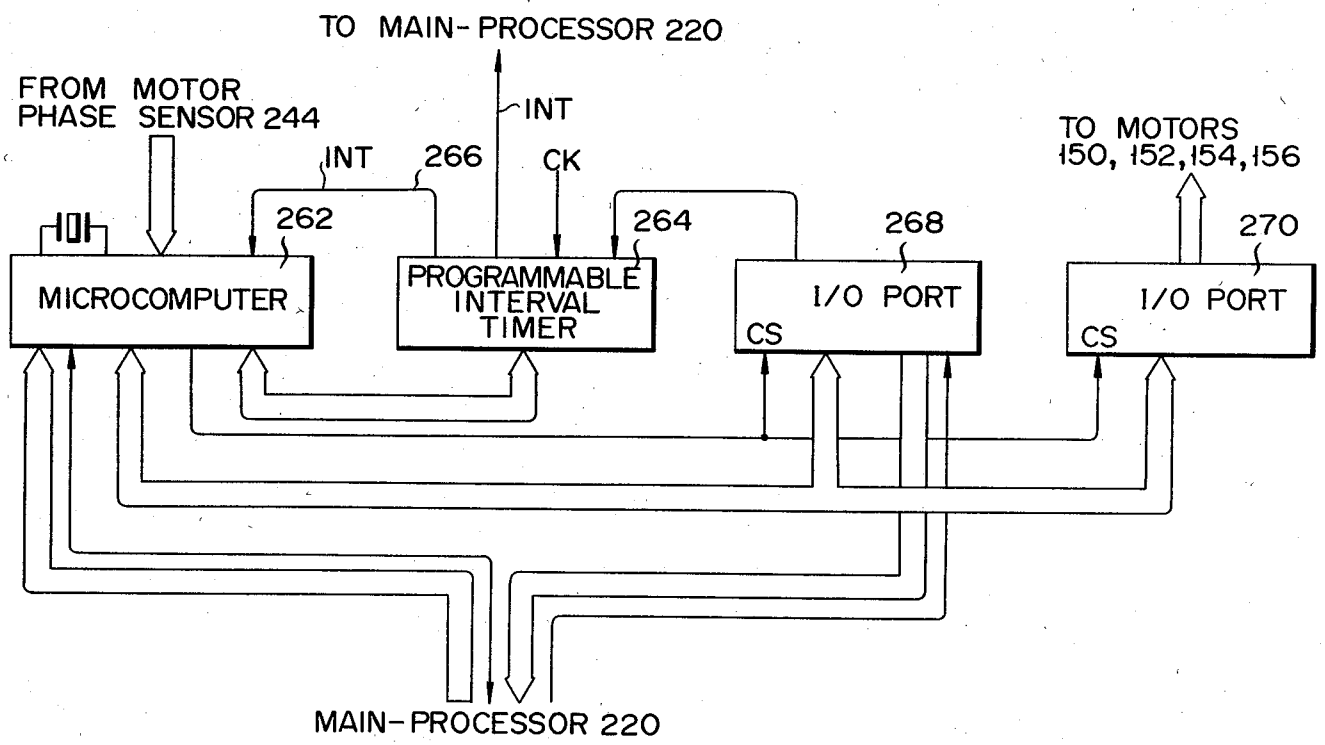

FIG. 12 shows a schematic illustration of the first sub-processor 222. A microcomputer 262 is connected to the main processor 220. A programmable interval timer 264 is provided to control the phase switching of the pulse motor. The microcomputer 262 sets a set value of the programmable interval time 264. Then, the programmable interval timer 264 starts the counting operation and produces an end pulse to the interrupt line 266 of the microprocessor 262 when the count value reaches the set value. A reference clock pulse CK is input to the programmable interval timer 264. The microcomputer 262 receives the position data from the motor phase sensor 244 and is connected to the I/O ports 268 and 270. The motors 150, 152, 154, and 156 are connected through the pulse motor driver 236 to the I/O port 270. The I/O port 268 outputs the status signal of each pulse motor to the main processor 220.

Figure 13:
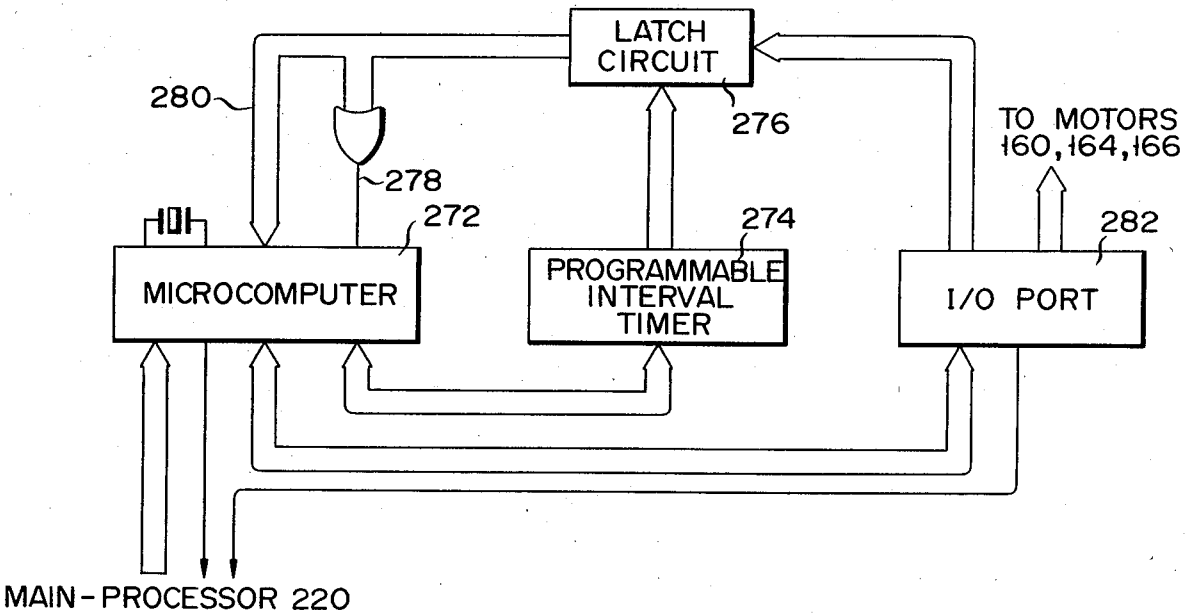

The arrangement of the second sub-processor 224 is shown in FIG. 13. A microcomputer 272 is connected to the main processor 220. A programmable interval timer 274 controls the time intervals for phase switching of the pulse motor. The microcomputer 272 sets a set value of the programmable interval timer 274. The programmable interval timer 274 produces an end pulse when the count value reaches the set value. The end pulse is latched in a latch circuit 276 of which the output is supplied to an interrupt line 278 of the microcomputer 272 and an input line 280. The microcomputer 272 is connected to an I/O port 282. The motors 160, 164 and 166 are connected through the pulse motor driver 238 to the I/O port 282.

Figure 14:
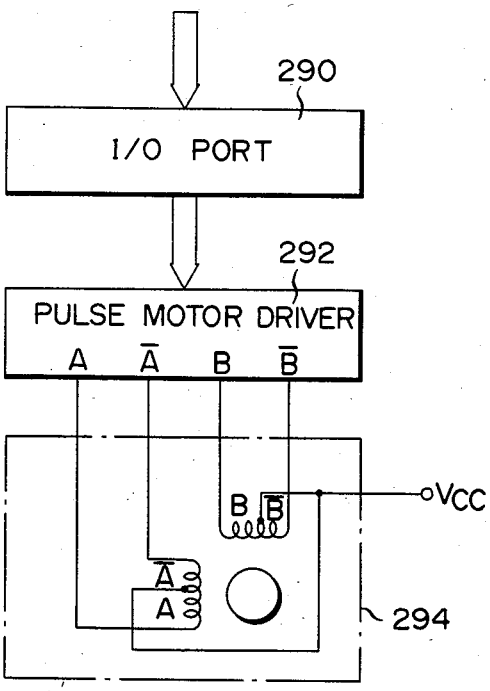
FIG. 14 is a block diagram showing a drive circuit for the pulse motor.

FIG. 14 shows the control circuit for the pulse motors. As shown, a pulse motor driver 292 (corresponding to the pulse motor drivers 236 and 238 in FIG. 10) is connected to an I/O port 290 (corresponding to the I/O ports 270 and 282 in FIGS. 12 and 13). The pulse motor driver 292 is connected to the windings A, $\overline{A}$, B and $\overline{B}$ of a pulse motor 294 (corresponding to the pulse motors 150, 152, 154, 156, 160, 164 and 166).

Figure 15:
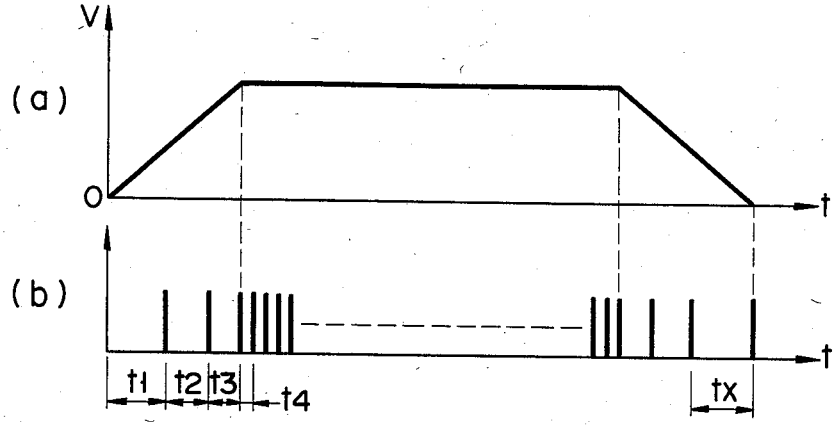
FIG. 15 shows a characteristic diagram depicting a speed control of the pulse motor.

FIG. 15 illustrates how the pulse motor's speed is controlled. FIG. 15A illustrates the speed curve of the pulse motor, and FIG. 15B illustrates the time intervals used in phase switching the motor. As seen from the graph, the time interval used in phase switching is long at the initial stage, and then gradually shorten becoming constant. Next, the time interval becomes gradually longer again, and the motor stops. In other words, the curve illustrates the so-called through-up and through-down, as it rises from the self-starting region, passes the high-speed region which is used in the motor operation for driving the related portions, and falls down. In the figure, t1, t2, . . . , tx indicate the time interval for phase switching.

The operation of a copy machine thus arranged will be described. Various copy conditions, such as the number of copies required or the size of copy sheet, are set up by the operation panel (FIG. 4). If the power is already ON, the main processor 220 judges as to whether a copy sheet is jammed or not in the transfer path using a signal from the jam detector 246. If the paper is jammed, the code for jam trouble is displayed by the copy number display 104. If a jam has not occurred the main processor 220 judges the size of the copy sheet on the basis of output from the cassette size sensors 50 and 52 and the signal from the upper or lower cassette select key 112 or 114. For example, the A4 size may be designated. As a result of this selection the main processor 220 supplies an initializing signal for the optical system to the first sub-processor 222, thereby controlling the motor 154. Specifically, the motor 154 is driven, and the first and second carriages 172 and 174 are moved. The first carriage 172 is moved up to a position equal to the width W of the selected copy sheet from the left end of the document table (FIG. 7). At this time, the main processor 220 lights the auxiliary display 206 to display the allowable range of the width on the document table 12. This enables the operator to see instantaneously as to whether the document falls within the allowable range. Further, the first subprocessor 222 drives the motors 150, 152, and 156 to set the lens block 34, the mirrors 28 and 30, and the shutter to an equal-magnification position. When the power is switched on, the main processor 220 also turns on the motor 168 which rotates the cooling fan 68 and turns on the heater 230. As the heater 230 reaches the fixing temperature, the operation panel 14 displays a copy ready condition. The operation up to this point is the initializing phase of the copy machine. The rest of the operating description for the copy machine will be explained in the following copy modes.

(I) One-Time Scanning/Single-Side Copy

A single A4-size document is put on the document table 12 and is aligned with the left end of the document table 12. When the start key 100 is depressed, the exposure lamp 24 lights up and the optical system moves to the left end of the document table 12. During the movement of the optical system, light from the exposure lamp 24 increases to a specified value. When the exposure lamp 24 moves to a specified distance, i.e., the through-up distance of the motor, from the left end of the document table 12, the rotating direction of the motor 154 is reversed. Then, the optical system moves to the right to scan the document. Scanning is performed in the high speed region of the pulse motor. Synchronized with the document scanning, the photosensitive drum 36 rotates forming the electrostatic latent image of the document thereon. The electrostatic latent image attracts toner as it passes through the developer 40. As the leading edge of the toner image reaches the transfer device 48, the leading edge of the copy sheet also reaches the transfer device 48 due to the well-timed rotation of the aligning roller pair 46 driven by the pulse motor 166. In this way, the toner image is transferred to the copy sheet, is then separated from the photosensitive drum 36, and finally is fixed by the fixing roller pair 158. The copy is finally discharged outside the machine through the discharge roller pair 60.

(II) One-Time Scanning/Double-Side Copy

In this mode, the gate 70 closes the discharge port, so that the copy sheet emanating from the discharge roller pair 60 is transferred to the inverting roller pair 72. The copy sheet reversed in its transfer direction is returned up to the aligning roller pair 46 through the transfer belts 74 and 76, and waits there for the succeeding copying operation. At this time, the copy sheet is reversed by the inverting path 78 and is fed to the aligning roller pair 46. Then, the first document is removed from the document table 12 and the second document is set thereon. The second document image is copied on the reverse side of the copy sheet through a process similar to that of the mode (I). At this time, the gate 70 retracts from the discharge port. Accordingly, the copy sheet bearing images on both sides is discharged outside the copy machine.

(III) Two-Time Scanning/Single Side Copy

Figure 16A:
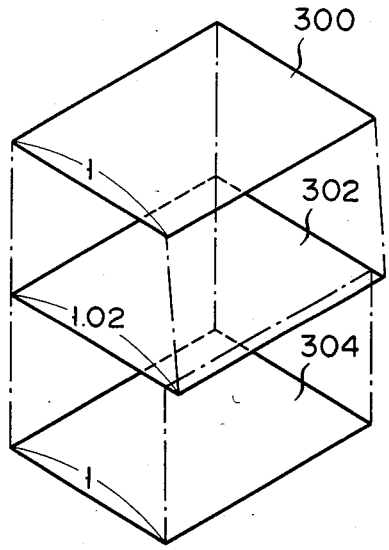
FIGS. 16A and 16B respectively illustrate the relationships between a toner image and a copied image in the operation modes of the embodiment shown in the FIG. 1.
Figure 16B:
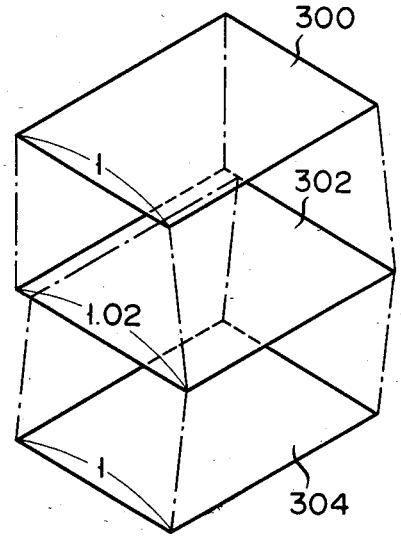

In this mode, two separate documents, or two pages of a notebook are set side-by-side on the document table 12. When the start key is pushed, the first document (left side) is scanned by the optical system as in the mode (I). However, the scanning speed of the optical system, i.e., the rotating speed of the motor 154, is 1/1.02 times that of the mode (I). The rotating speed of the photosensitive drum 36 is the same as in the mode (I). Thus, the scanning speed is slower, and the scanning distance per unit time is 1.02 times longer. The image formed on the photosensitive drum 36 is enlarged 1.02 times that of the document image as measured in the scanning direction. The operation timing of the aligning roller pair 46 is the same as in the mode (I). With this timing, the toner image corresponding to the left end of the document is transferred to the copy sheet so as to exactly align with the leading edge of the copy sheet. The width of the toner image is 1.02 times the width of the copy sheet. Therefore, the end portion of the toner image, i.e., the right end of the document, extends beyond the copy sheet. Therefore, the images at the joint line portion between the first and second documents are not copied. This is illustrated in FIG. 16A. The width of the document 300, extending in the scanning direction, is enlarged 1.02 times to provide an enlarged toner image 302. The toner image 302 is cut off at the right end portion, and copied on the copy sheet 304 with the same size as that of the document. In this way, the copy sheet bearing an image with a slightly enlarged width and lacking the right end portion of the document image is taken out of the copy machine. At this time, the optical system stays at the scanning end point of the first document. When the first copy is discharged outside the machine, the optical system is returned to the left by the through-up distance of the pulse motor, and then is moved to the right for scanning a second document. Also at this time, the scanning speed of the optical system is 1/1.02 times that of the one-time scanning mode (the modes I and II). Therefore, an image with a width 1.02 times that of the actual document is formed on the photosensitive drum 36. The operation timing of the aligning roller pair 46 is slower than the first document copying, and is controlled so that the right end of the document is exactly aligned with the trailing end of the copy sheet. Therefore, the left end of the second document, i.e., closer to the first document, is not copied, as shown in FIG. 16B. Thus, in this mode (III), the space between the two documents is not copied. This indicates that even if the machine is operated in the two-time scanning mode, the joint portion is never copied as a black line, unlike in the prior art. If the scanning speed is reduced below 1/1.02, the copied image appears to be unnatural in the lateral direction. On the other hand, if the scanning speed is within the range between 1/1.02 and 1.00, the black stripe problem remains unsolved. Thus, eventually, it is best that the scanning speed is set not too much above or below 1/1.02.

(IV) Two-Time Scanning/Double-Side Copy

The setting of the documents and the scanning of the documents are the same as in the mode (III). The difference from the mode (III) is that the image of the second document is copied by gate 70 action on the reverse side of the copy sheet of which has on the obverse side the image of the first document.

The above description refers to the copying operation when only one copy is desired. For copying more than one copy, the above operation is simply repeated.

As described in the modes (III) and (IV) above, the copy machine according to the present invention successfully solves the black stripe problem that conventionally occurs when two documents are arranged side-by-side on the document table and copied in a successive manner.

The first carriage 172 for supporting the exposure lamp 24 and the mirror 26 in the optical system has as its home position a position equal to the width of the copy sheet from the left end of the document table 12. Further, the first carriage 172 is provided with the auxiliary display 206. The copy allowable range is visualized on the document table 12. Additionally, since the home position is at the center of the main frame, less moment is required for opening the upper unit when a jam occurs.

Figure 17:
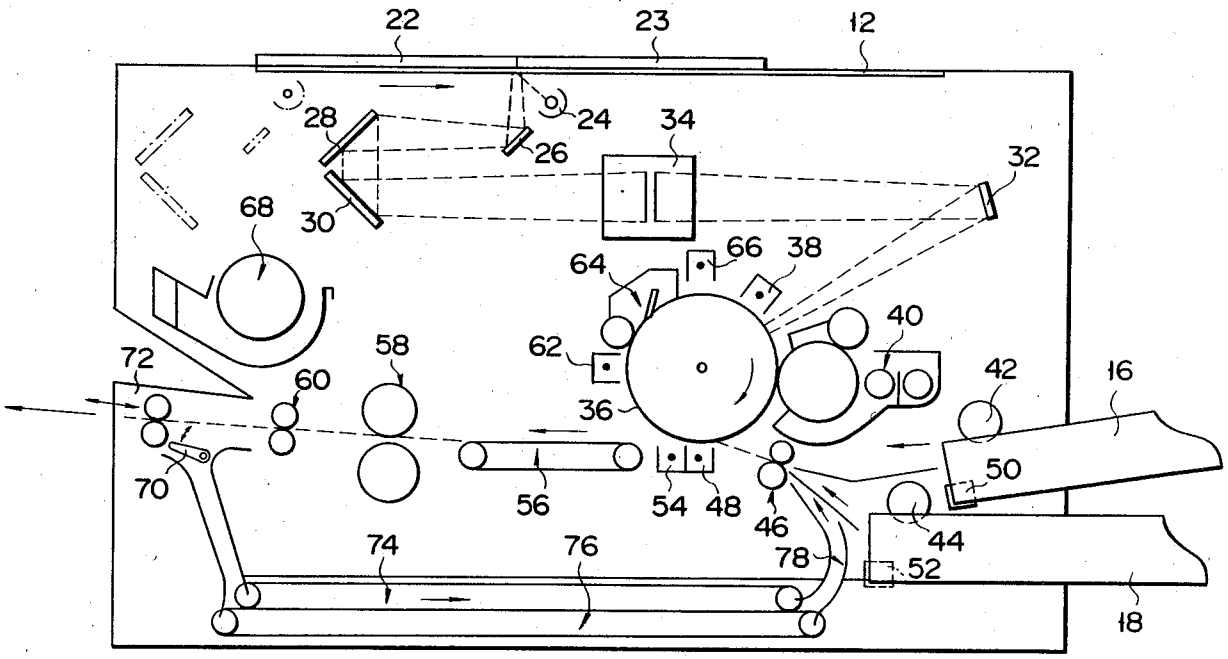
FIG. 17 illustrates in cross section a scheme of a modification of the embodiment shown in FIG. 1.

One of the modifications of the first embodiment is that the pair of inverting rollers 72 may be disposed closer to the gate 70, as shown in FIG. 17.

A second embodiment of a copy machine according to the present invention will now be described.

Figure 18:
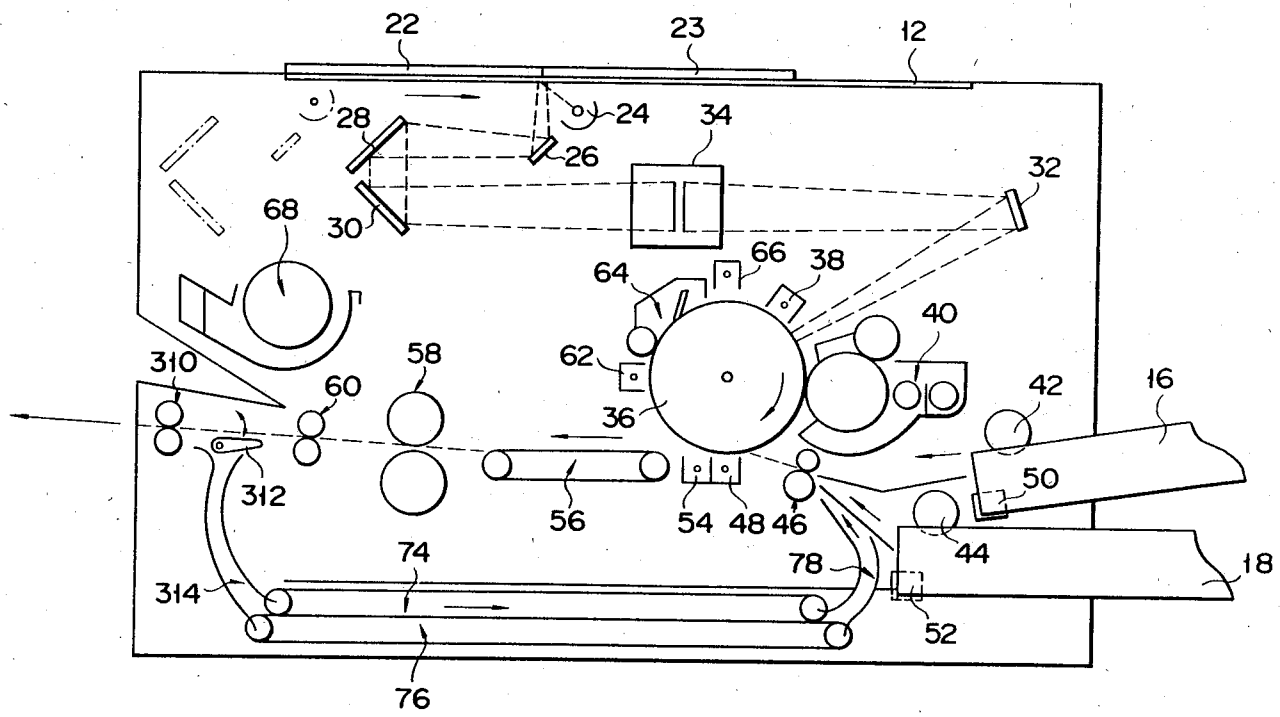
FIG. 18 illustrates in cross section a scheme of a second embodiment of a copy machine according to the present invention.

The second embodiment's function does not include producing double-sided copy, rather its' function is to superpose copy. Of course, the two-time scanning mode or the one-time scanning mode may be selected. The cross sectional structure of the second embodiment is shown in FIG. 18. In FIG. 18, like reference numerals are used for designating the like or equivalent portions of FIG. 2 of the first embodiment. In the present embodiment, the copy is discharged from the machine, not directly through the discharge roller pair 60, but through a feed roller pair 310. A gate 312 is provided between the discharge roller pair 60 and the feed roller pair 310 which directs the copy sheet to the feed roller pair 310 or the inverting path 314. The copy sheet which was directed to the inverting path 314 is then transferred to the transfer belts 74 and 76. The copy is next sent to the aligning roller pair 46 through the inverting path 78.

Figure 19:
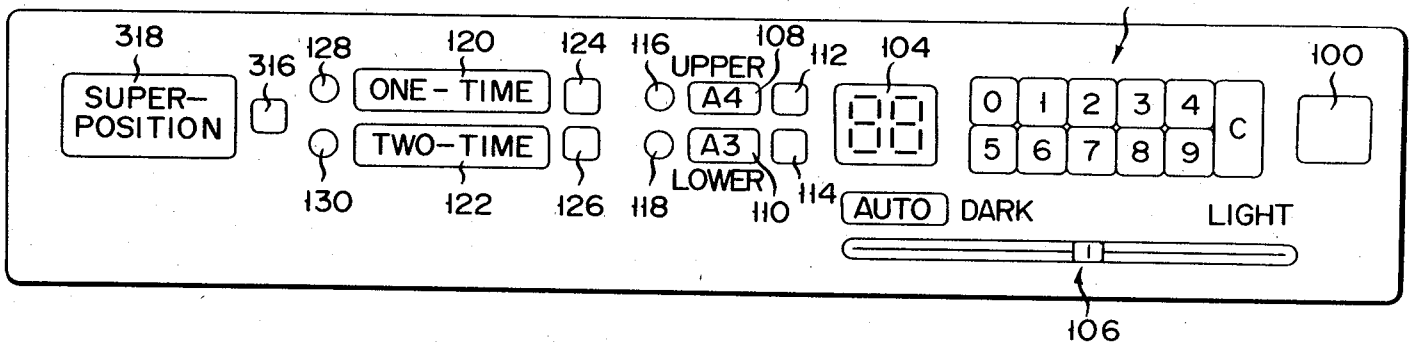
FIG. 19 shows a plan view of an operation panel of the second embodiment.

FIG. 19 is a plan view of the operation panel in the second embodiment. As shown, a superposition copy select key 316 and a display 318 for displaying the selection are provided in place of the select key for the single-side or the double-side copy mode of the first embodiment. When the superposition copy mode is not selected, the copy machine is in the normal mode (the mode I or III in the first embodiment).

The remaining arrangement of the second embodiment is substantially the same as that of the first embodiment.

The operation of the second embodiment will next be described. The operation is classified into four modes; (I) one-time scanning/normal copy, (II) one-time scanning/superposition copy, (III) two-time scanning/normal copy, (IV) two-time scanning/superposition copy.

In the modes I and III, the operation of the copy machine is the same as in the modes I and III of the first embodiment. In those modes, the gate 312 is positioned as shown in FIG. 18 so that each copied sheet is quickly discharged.

In the modes II and IV, the gate 312 blocks the transfer path to the outside of the copy machine and directs the copied sheet to the inverting path 314. The copied sheet is returned to the aligning roller pair 46 through the inverting paths 314 and 78. Note here that since the copied sheet passes through two inverting paths, the copy sheet is not inverted, unlike the first embodiment. In the mode (II), at this point, the document is replaced with another document, and the image of the second document, upon the copy starting signal, is copied on the copy sheet superposed on the already copied image of the first document. In the mode (IV), the second scanning of the second document is automatically started in order to superpose this copy. Also in the second embodiment, in the two-time scanning mode, i.e., the mode (III) or (IV) the scanning speed of the optical system is slower than that in the mode (I) or (III). Accordingly, the image at the joint portion of the two documents is not copied. The superposition copy mode may be used where one of the documents contains frames such as a table, and the other contains characters which fill the frames of the first document. In other words, the two documents are superposed to form a composite image of a table.

In both of the two embodiments, the scanning speed of the optical system is slowed down in the two-time scanning mode to only enlarge the width of the document. Alternatively, an enlarged toner image $1.02 \times 1.02$ times the document image may be formed on the drum by using a magnification changing lens block 34 with a fixed scanning speed. Also in this case, the timing of the aligning roller pair 46 for the rotation of the drum 36 is adjusted. If this modification is made, the document image is uniformly enlarged both in length and in width. By enlarging the entire document, any deformation of the copied image in the lateral direction is removed.

In the above-mentioned embodiments, when two documents are arranged on the document table, scanning is performed for each document, because it is impossible to feed two copy sheets to the aligning roller pair 46 in a successive manner. Alternatively, if the machine is structured such that two copy sheets can be successively fed to the aligning roller pair 46 in a side-by-side fashion as the documents are arranged on the document table, a couple of documents may be scanned at one time and the latent images of the documents may be formed on the drum in a succesive manner. Further, the aligning roller pair 46 is controlled to make the appropriate time lag between the two copy sheets in order to remove the joint portion of the copy sheets. In this case, setting one or two documents on the document table is not called one-time scanning or two-time scanning, rather it is called one-time copying or plural-times copying.

As described above, the copy machine according to the present invention successfully eliminates the black stripe which represents the joint portion of the two documents when they are arranged side-by-side on the document table.

It should be understood that the present invention may variously be changed and modified within the scope of the invention.

What is claimed is:

1. A copy machine comprising:

a photosensitive member;

document table means for supporting a document having first and second adjacent frames;

optical means for sequentially illuminating the first and second frames of a document supported by said table means with an interval period between the illuminations of the first and second frames, for enlarging the optical images of the first and second frames of said document formed by light reflected from said document, and for forming enlarged latent images corresponding to said enlarged optical images on said photosensitive member;

means for transferring the latent images on the photosensitive member to a surface; and means for successively feeding to said transferring means at least two surfaces to which the latent imaqes of said first and second frames are to be respectively transferred to, each of said surfaces having dimensions equal to the dimensions of one frame of said document such that a leading edge of the first of said two surfaces is aligned with a leading portion of the image on the drum of the first frame and a trailing edge of the second surface is aligned with a trailing portion of the image on the drum of the second frame.

2. A copy machine according to claim 1, in which:

said document includes two rectangular pages arranged side-by-side on said document table, and said optical means includes means for horizontally scanning each of said rectangular pages with an exposure lamp with a length equal to the longitudinal side of said rectangular pages, and means for reflecting images of said illuminated pages toward said photosensitive member; and said machine further includes means for rotating said photosensitive member in synchronism with the scanning of said exposure lamp.

3. A copy machine according to claim 2, wherein:

said photosensitive member comprises a drum; and said rotating means rotates said photosensitive drum over an angular displacement corresponding to a distance on the surface thereof longer than the width of one of said surfaces fed by said feeding means when said exposure lamp scans the width of one page.

4. A copy machine according to claim 3, in which said distance on the surface of said photosensitive drum produced when said photosensitive drum rotates during the scanning of the width of one page by said exposure lamp is within the range of 1.00 to 1.02 times the width of one of the surfaces fed by said feeding means.

5. A copy machine according to claim 3, in which said transferring means transfers an image of a left-most one of the first and second pages of the document supported by said document table so that the leading edge of the corresponding image on said photosensitive drum is aligned with the leading edge of one of the surfaces fed by said feeding means, and transfers an image of a right-most one of said first and second pages so that the trailing edge of the corresponding image on said photosensitive drum is aligned with the trailing edge of the fed surface.

6. A copy machine according to claim 1, in which said transfer means transfers two document images onto the surfaces of separate copy sheets.

7. A copy machine according to claim 1, in which said transfer means transfers the two document images respectively onto two surfaces of same copy sheet.

8. A copy machine according to claim 1, in which said transfer means superimposes two document images on a single surface of a copy sheet.

9. A copy machine according to claim 1, in which said optical means further includes a magnification changing lens means for enlarging the optical image.

10. A copy machine according to claim 9, in which magnification of said magnification changing lens block ranges from $1.02 \times 1.02$ to $1.00 \times 1.00$.

11. A copy machine according to claim 1, in which said optical means illuminates the first and second frames one by one and illuminates the second frame after the transfer of an image of the first frame.

12. A copy machine according to claim 1, in which said optical means successively illuminates two documents of two images.

13. A copy machine according to claim 1, wherein said optical means includes carriage means for scanning said document with an exposure lamp, the carriage means being located at a scanning end position during the interval period between the illuminations of the first and second frames, said carriage means also for enlarging images of the first and second frames.

14. A copy machine according to claim 1, in which said feeding means feeds said first and second surfaces such that a leading edge of the first surface is aligned with a leading edge of the image on the drum with some distance at an image transfer of the first frame and a trailing edge of the second surface is aligned with a trailing edge of the image on the drum with a given distance at an image transfer of the second frame.

15. A copy machine according to claim 1, in which said feeding means includes a plurality of paper cassette means each for storing sheets of a different size, means for selecting the paper cassette means storing sheets of the size is equal to one frame of said document, and paper feed roller means for feeding the sheets of a size equal to the size of said document from said selected cassette means to said feeding means.

16. An apparatus for photocopying adjacent pages comprising:

means for supporting first and second rectangular pages each of a predetermined width and height and arranged such that a first edge of a first page is in contact with a second edge of said second page;

means for selectively directing light alternately toward said first page and said second page;

a photosensitive drum;

means for rotating said drum;

means for alternately directing light reflected by said first and second pages toward said drum to form latent images thereon, said images being enlarged by a predetermined factor only in the direction corresponding to the dimension between a second edge of said first page parallel to said first edge and said first edge of said first page;

means for conveying a first and second medium along a conveyance path in contact with said rotating drum, said conveying means including means for selectively (1) aligning an edge of said conveyed first medium with an edge of a latent image formed on said drum corresponding to the second edge of said first page and (2) aligning an edge of said second medium with an edge of a latent image corresponding to a first edge of said second page parallel to said second edge of said second page; and means for transferring the entire latent images formed on said drum from said drum to said medium except for the portion of images corresponding to the first edge of said first page and the portion of images corresponding to the second edge of said second page.

17. An apparatus as in claim 16 wherein:

said directing means includes:

an exposure lamp, and means for scanning said exposure lamp alternately from (a) said second edge of said first page to the first edqe thereof at a predetermined rate and from (b) the second edge of said second page to the first edge thereof at said predetermined rate; and said rotating means rotates said drum at a second predetermined rate slower than said predetermined scanning rate.

18. An apparatus as in claim 16 wherein said predetermined enlargement factor is within the range of 1.00 and 1.02.

19. A method of photocopying adjacent pages comprising the steps of:

(1) placing first and second rectangular pages each of a predetermined width and height onto a document table;

(2) placing a first edge of said first page in contact with a second edge of said second page;

(3) directing light toward said first page;

(4) forming a latent image enlarged by a first predetermined factor on a rotating photosensitive drum, said image corresponding to the portion of the light directed by said directing step (3) and reflected by said first page, said image being enlarged only in the dimension corresponding to the dimension between a second edge of said first page parallel to said first edge and the first edge of said first page;

(5) conveying a first medium having dimensions equal to the dimensions of the first page along a conveyance path in contact with said rotating drum, including the step of aligning an edge of the latent image formed by said forming step (4) corresponding to the second edge of said first page with an edge of said first medium;

(6) transferring the entire latent image formed by said forming step (4) from said drum to said first medium except for the portion of said image corresponding to said first edge of said first page;

(7) subsequent to said transferring step (6), directing light towards said second page;

(8) forming an image enlarged by another predetermined factor on the rotating photosensitive drum, said image corresponding to the portion of the light directed by said directing step (7) and reflected by said second page, said image being enlarged only in the dimension corresponding to the dimension between said second page second edge and a first edge of said second page parallel to said second edge thereof;

(9) conveying a second medium having dimensions equal to the dimensions of said second page along said conveyance path in contact with said rotating drum, including the step of aligning the edge of said image corresponding to said first edge of said second page with an edge of said second medium; and

(10) transferring the entire latent image formed by said forming step (8) from said drum to said second medium except for the portion of said image corresponding to the second edge of said second page.

20. A method as in claim 19 wherein:

said directing step (3) includes the step of scanning an exposure lamp from the second edge of said first page to the first edge thereof at a first predetermined rate;

said directing step (7) includes the step of scanning the exposure lamp from the second edge of said second page to the first edge thereof at said first predetermined rate; and said transferring steps (6) and (10) each include the step of rotating said drum at a second predetermined rate slower than said first predetermined scanning rate.

21. A method as in claim 19 wherein said first and another predetermined enlargement factors are each within the range of 1.00 and 1.02.

* * * * *